US005997026A

United States Patent [19]

Klubitschko et al.

[11] Patent Number: 5,997,026

[45] Date of Patent: Dec. 7, 1999

[54] BOOT-RETAINING UNIT OF A DISENGAGEABLE SKI BINDING

[75] Inventors: Gerd Klubitschko, Oberammergau; Edwin Lehner, Farchant; Johann Schuhbauer, Weilheim; Gerhard Sedlmair, Farchant; Premek Stepanek, Garmisch-Partenkirchen, all of Germany

[73] Assignee: Marker Deutschland GmbH, Eschenlohe, Germany

[21] Appl. No.: 08/927,127

[22] Filed: Sep. 5, 1997

[30] Foreign Application Priority Data

Sep. 11, 1996 [DE] Germany ..... 196 36 886

[51] Int. Cl.[6] ..... A63C 9/081; A63C 9/22

[52] U.S. Cl. ..... 280/607; 280/626; 280/636

[58] Field of Search ..... 280/607, 611, 280/623, 625, 626, 633, 634, 635, 636

[56] References Cited

U.S. PATENT DOCUMENTS

| | | | |
|---|---|---|---|
| 5,044,658 | 9/1991 | Challande et al. | 280/631 |
| 5,529,331 | 6/1996 | Hoelzl et al. | 280/634 |
| 5,687,982 | 11/1997 | Challande et al. | 280/607 |

FOREIGN PATENT DOCUMENTS

| | | | |
|---|---|---|---|
| 353 145 | 10/1979 | Australia . | |
| 0 480 328 A1 | 10/1991 | European Pat. Off. . | |
| 26 29 452A1 | 1/1978 | Germany . | |
| 28 02 775C2 | 7/1979 | Germany . | |
| 34 03 472A1 | 8/1985 | Germany . | |
| 4203255A1 | 8/1992 | Germany | 280/629 |
| 40 23 569 | 8/1993 | Germany . | |
| 511 039 | 6/1970 | Switzerland . | |
| 673403A5 | 12/1987 | Switzerland | 280/625 |

*Primary Examiner*—J. J. Swann
*Assistant Examiner*—Christopher Bottorff
*Attorney, Agent, or Firm*—D. Peter Hochberg

[57] ABSTRACT

A boot-retaining arrangement, which can be disengaged in the sideways direction, and a carrying part of the same are arranged with vertical play relative to the upper side of the ski and are stressed against the upper side of the ski by means of a leaf spring or a lever part. The forces acting here and the force of a separate spring for controlling sideways disengagement are changed by a common actuating element.

27 Claims, 9 Drawing Sheets

Fig. 7
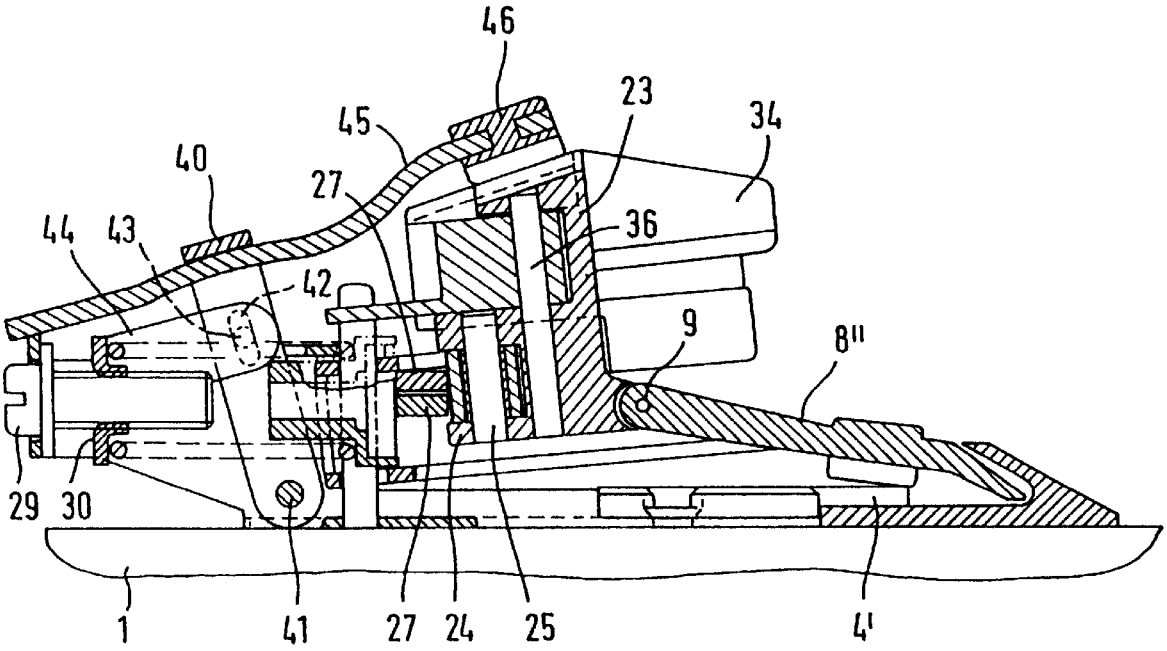
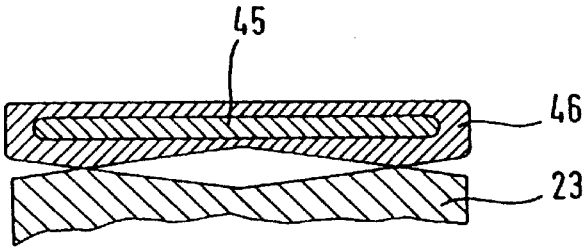
Fig. 8

BOOT-RETAINING UNIT OF A DISENGAGEABLE SKI BINDING

BACKGROUND OF THE INVENTION

1. Field of the Invention

The invention relates to a boot-retaining unit of a disengageable ski binding, in particular a boot-retaining unit for retaining the toe region of a ski boot, having a first adjustable spring unit for controlling disengagement of the ski boot in the direction of a transverse axis of the boot and an adjustable supporting unit or a second adjustable spring unit for controlling disengagement of the ski boot in the direction of a vertical axis of the boot.

2. Description of the Prior Art

Boot-retaining units of this type are known in principle and are commercially available. DE-A 26 29 452 describes such a unit by way of example. In this document, the binding has, on the one hand, disengageable boot-retaining means which secure the boot with limited force in the sideways direction and, on the other hand, a boot-retaining means which is separate from those already mentioned and which secures the ski boot against an upward movement relative to the upper side of the ski. All of these boot-retaining means are retained on separate leaf springs which are designed as channel profiles, the convex side being oriented in the respective disengagement direction.

DE 42 03 569 Al also discloses boot-retaining units in which boot-retaining means which can be disengaged in the sideways direction and also secure the ski boot against a movement in the vertical direction relative to the ski are arranged on a common housing which is mounted so as to be pivotable around a transverse axis of the ski, a single disengagement spring mechanism forcing the boot-retaining means, on the one hand, and the housing, on the other hand, into a normal position. It is advantageous here that, with a change in the spring stressing of the disengagement spring mechanism, both the disengagement force in the sideways direction and the disengagement force in the vertical direction are changed simultaneously. However, the design outlay is comparatively high. Furthermore, it is not possible, without relatively large design modifications, to change the size ratio between the disengagement forces in the sideways and vertical directions.

SUMMARY OF THE INVENTION

The object of the invention is thus to present a particularly advantageous design for a boot-retaining unit of the type specified in the introduction.

This object is achieved according to the invention in that an actuating element for simultaneously adjusting the two spring units or for simultaneously adjusting the first spring unit and the supporting unit interacts with, or is coupled to, an adjustable abutment of the first and of the second spring units or of the supporting unit.

The invention is based on the general idea of providing separate units for different disengagement directions and of using a common actuating element, which controls abutments of the two units, to carry out simultaneous adjustments of the disengagement forces assigned to the respective disengagement directions or simultaneous changes in the disengagement behaviour in the two disengagement directions. This provides a large degree of design freedom as regards the ratio between the disengagement forces which act in different directions. Essentially, all that is required is for the shape of the abutments and/or the coupling between the abutments and the actuating elements to be modified.

According to a preferred embodiment of the invention, it is provided that the first spring unit has a helical compression spring, of which the compressive stressing can be adjusted by a spring abutment, which can be adjusted in the direction of the spring axis by means of the actuating element, at one end of the helical compression spring, and that the actuating element or the spring abutment is coupled to a lever element, which forms an adjustable support of a leaf spring, which is arranged as the spring element of the second spring unit or of a lever part of the supporting unit. It is advantageous here that the helical compression spring provided for controlling sideways disengagement can be arranged in basically the same way as in the case of conventional boot-retaining units which can only be disengaged in the sideways direction, and that: virtually no additional space is required for the leaf spring, or the lever part, provided for controlling disengagement in the vertical direction.

In particular, provision may be made, in an expedient configuration of the invention, for a boot-retaining arrangement, which can be disengaged in the sideways direction, to be arranged with a certain degree of vertical play relative to the upper side of the ski and for this boot-retaining arrangement to be pressed down in the direction of the upper side of the ski by means of the leaf spring or of the lever part, which may also be designed as a rocker. As soon as the ski boot raises the boot-retaining arrangement to a sufficient extent counter to the force of the leaf spring, disengagement in the upward direction takes place.

BRIEF DESCRIPTION OF THE DRAWINGS

As regards preferred features of the invention, you are referred to the claims and to the following explanation of the drawings, which describe a particularly preferred configuration of the invention and in which:

FIG. 7 shows a sectional illustration which corresponds to FIG. 2 and shows the conditions in the event of vertical disengagement, FIG. 8 shows a sectional view corresponding to section line VIII—VIII in FIG. 2.

DESCRIPTION OF THE PREFERRED EMBODIMENTS

Figure 1:
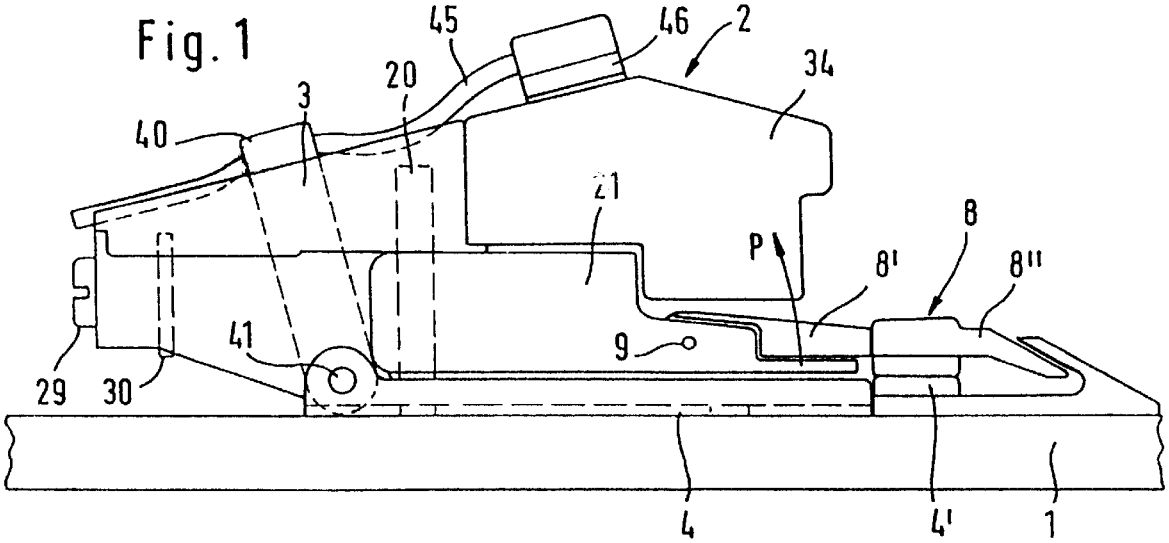
FIG. 1 shows a side view of a boot-retaining unit 2.

On a base plate 4, which is arranged fixedly on the upper side of a ski, there are arranged, on both sides of the longitudinal axis of the ski, two very stable, ski-mounted vertical pins 20 on which there are pivotably mounted the front ends, as seen in the longitudinal direction of the ski, of two stable guide links 21, of which the rear ends, as seen in the longitudinal direction of the ski, are connected pivotably, via articulation pins 22, to a front section, as seen in the longitudinal direction of the ski, of a sliding plate 8 parallel to the upper side of the ski. In a plan view of the upper side of the ski, the vertical pins 20 and the articulation pins 22 form a parallelogram-like or trapezoidal quadrilateral.

The guide links 21 and their articulation eyelets, through which the vertical pins 20 pass, are designed such that the guide links 21 can also be pivoted in the direction of the arrow P in FIG. 1, i.e. those ends of the guide links 21 which are remote from the vertical pins 20 can be moved, together with the sliding plate 8, in the upward direction relative to the upper side of the ski 1 or of the base plate 4. For this purpose, it is possible for the guide links 21 to have in each case, on their top horizontal borders, a round hole through which the respective vertical pin 20 passes and which encloses the vertical pin 20 without any significant radial play. Toward the bottom horizontal border of the respective guide link 21, said round hole widens to a slot which extends in the longitudinal direction of the guide link 21. This ensures the abovementioned capacity for vertical movement of those ends of the guide links 21 which are connected to the sliding plate 8. If appropriate, it is possible for the guide links 21, as seen in the longitudinal direction of the ski, to have a C-profile in the region of the vertical pins 20. In this case, the round hole is provided in the top C-leg, and the slot is provided in the bottom C-leg, on the bottom horizontal border of the respective guide link 21.

Figure 2:
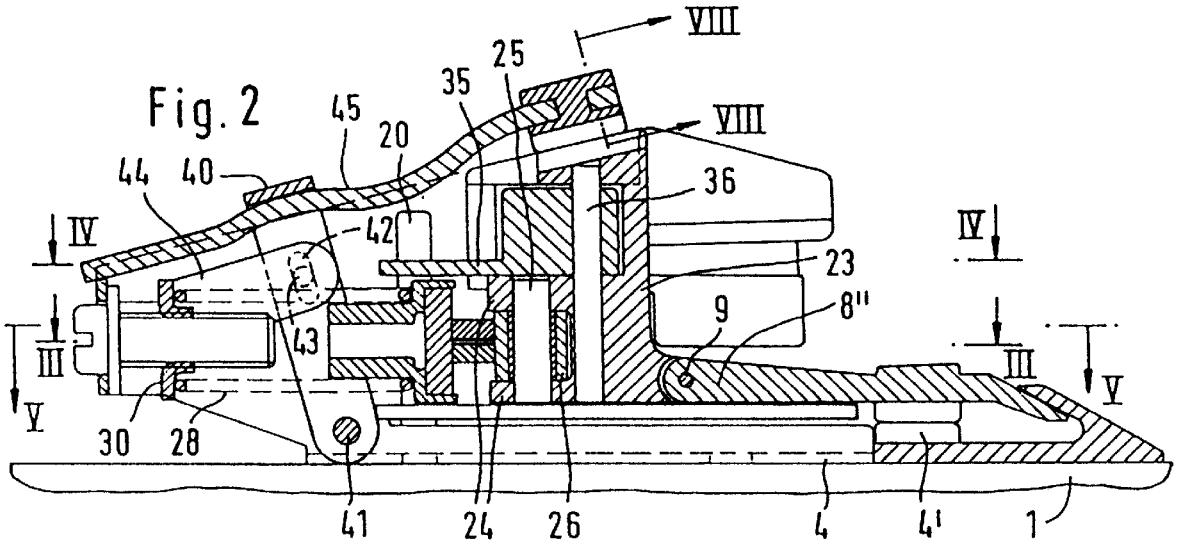
FIG. 2 shows a vertical longitudinal section.
Figure 3:
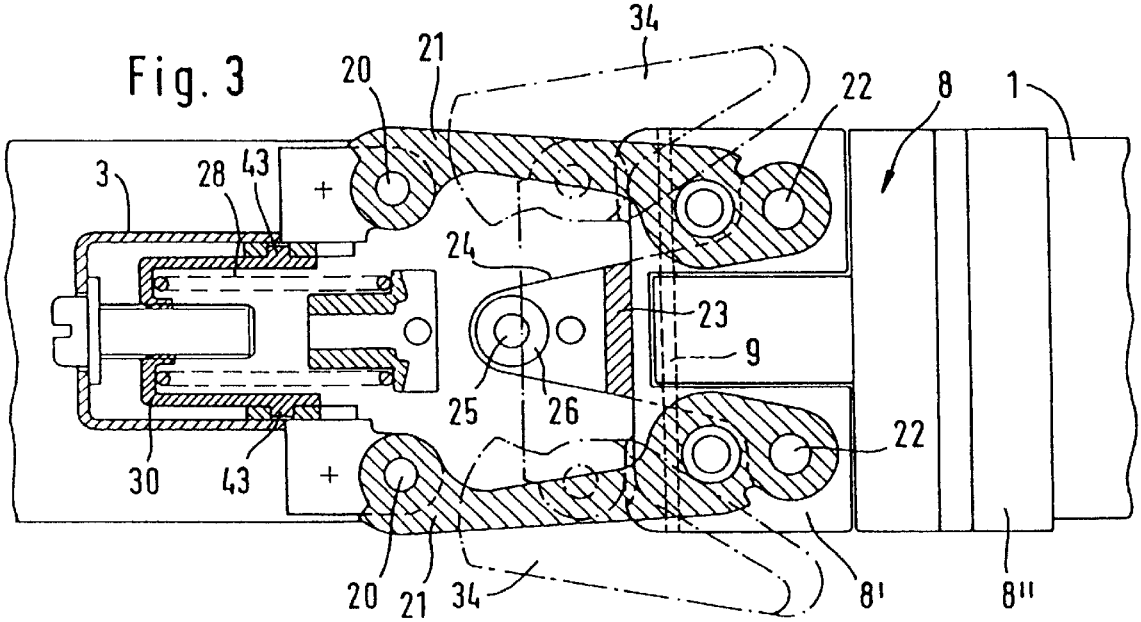
FIG. 3 shows a horizontal section corresponding to section line III—III in FIG. 2, although guide arms 27 are not illustrated.

As can be seen, in particular, from FIGS. 2 and 3 and 8, the sliding plate 8 preferably is designed in two parts, a front plate part 8' being connected in an articulated manner to the guide links 21 and a rear plate part 8" being arranged on the front plate part. 8' so as to be pivotable around a transverse pin 9. In this case, the rear transverse border of the rear plate part 8" is received, in the same way as it would be in a guide rail, by an extension which lengthens the base plate 4 and, in a view in the transverse direction of the ski, forms a V-profile which is open toward the tip of the ski.

Integrally formed on the front region of the front sliding-plate part 8' is a stable transverse wall 23 which projects in the upward direction and has a central extension 24 which is oriented in the forward direction of the ski and is designed as a bearing block for a roller 26 which can be rotated around a pin 25 which is perpendicular with respect to the upper side of the ski. The roller 26 interacts with guide arms 27, see in particular FIG. 5, which are mounted pivotably, on the ski-mounted vertical pins 20, in corresponding recesses in the guide links 21. The guide arms 27 are forced against the roller 26 by a helical compression spring 28. For this purpose, the helical compression spring 28 is supported on an abutment 30 which can be displaced in the longitudinal direction of the ski by means of an adjustment screw 29 and, for its part, is supported, via the adjustment screw 29, on a front end wall of a housing which is connected fixedly to the base plate 4. The other end of the spring 28 is stressed against a piston-like part 31 which, on its end side which is directed toward the guide arms 27, retains a pin 32 which is parallel to the vertical axis of the ski and by means of which the piston-like part 31 engages, under the pressure of the helical compression spring 28, in corresponding recesses on the guide arms 27, said recesses being open toward the front end of the ski.

Figure 5:
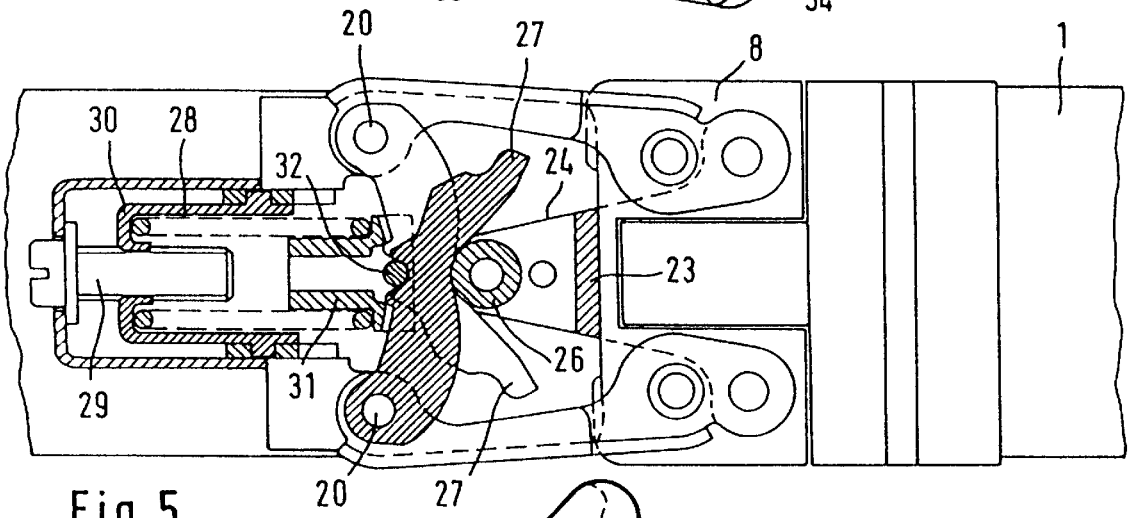
FIG. 5 shows a horizontal section corresponding to section line V—V in FIG. 2.

In the plan view of FIG. 5, the criss-crossing guide arms 27 form, by means of their borders which are directed toward the sliding plate 8, a V-like recess, which receives the roller 26 and is open toward the sliding plate 8, and try to move the roller 26, and thus the sliding plate 8, into a centered position with respect to the longitudinal axis of the ski.

If the sliding plate 8 is subjected to a relatively large force in the transverse direction of the ski, then it is moved transversely with respect to the ski 1, for example in the upward direction in FIG. 5, in which case the roller 26 then pivots one of the guide arms 27, that which is illustrated by dark shading in FIG. 5, with the helical compression spring 28 being stressed increasingly in the process. In this case, the guide-like borders of the guide arms 27 which interact with the roller 26 are designed such that, in the area surrounding the normal position of the sliding plate 8, this position being illustrated in FIG. 5, comparatively large transverse forces have to act on said sliding plate 8 in order to displace the latter sideways out of the illustrated center position. As sideways displacement increases, the forces which are necessary for further displacement can then become comparatively small.

Arranged at the lateral ends of the transverse wall 23, above the guide links 21, are sole-retaining means 34 (see in particular FIG. 4), which are connected to the transverse wall 23 in a hinge-like manner so as to be pivotable around pins 33 which are parallel to the vertical axis of the ski. In a plan view of the upper side of the ski, these sole-retaining means 34 form double-arm levers, the lever arms which project in the rearward direction of the ski being formed such that they can engage around the borders of the front sole region of the ski boot from above, from the front and from the sides. Relatively weak spring elements (not illustrated) force the sole-retaining means 34 elastically into an end position, in which they engage around the lateral borders of the front sole region in a tong-like manner.

Figure 4:
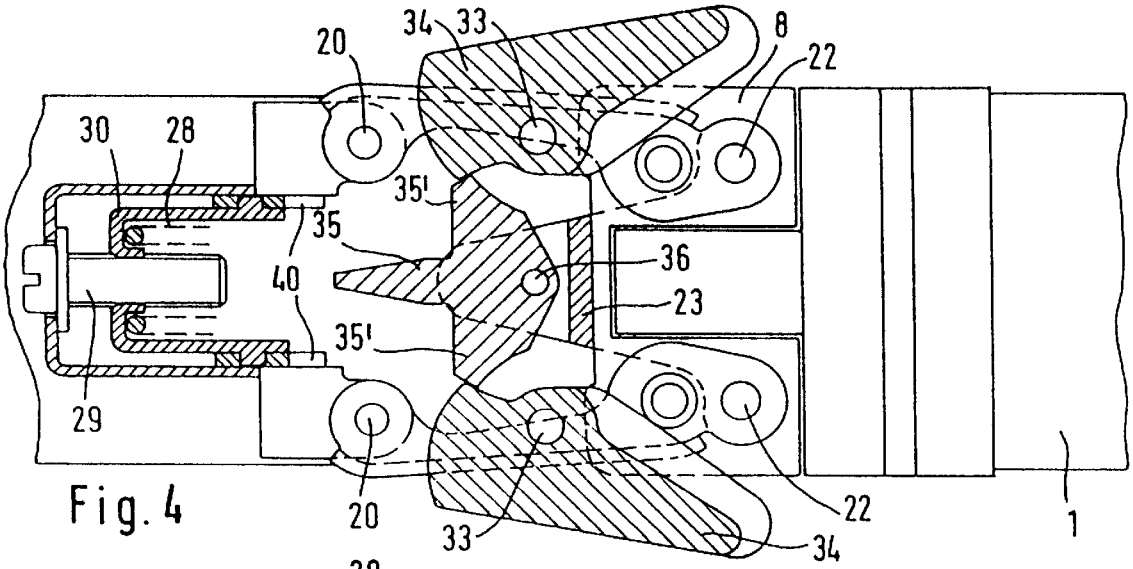
FIG. 4 shows a horizontal section corresponding to section line IV—IV in FIG. 2.

The other arms of the sole-retaining means 34, that is to say the arms which are oriented in the forward direction of the ski, interact with a locking lever 35, which is mounted on the transverse wall 23 of the sliding plate 8 so as to be pivotable around a pin 36 parallel to the vertical axis of the ski and, by means of weak spring elements (not illustrated), is forced into the normal position, which is illustrated in FIG. 4 and in which two lateral extensions 35' of the locking lever 35 rest laterally against those arms of the sole-retaining means 34 which are oriented in the forward direction of the ski. These sole-retaining means 34 are consequently locked in the position of FIG. 4, i.e. those arms of the sole-retaining means 34 which engage around the sole borders in a tong-like manner cannot be spread apart.

Figure 6:
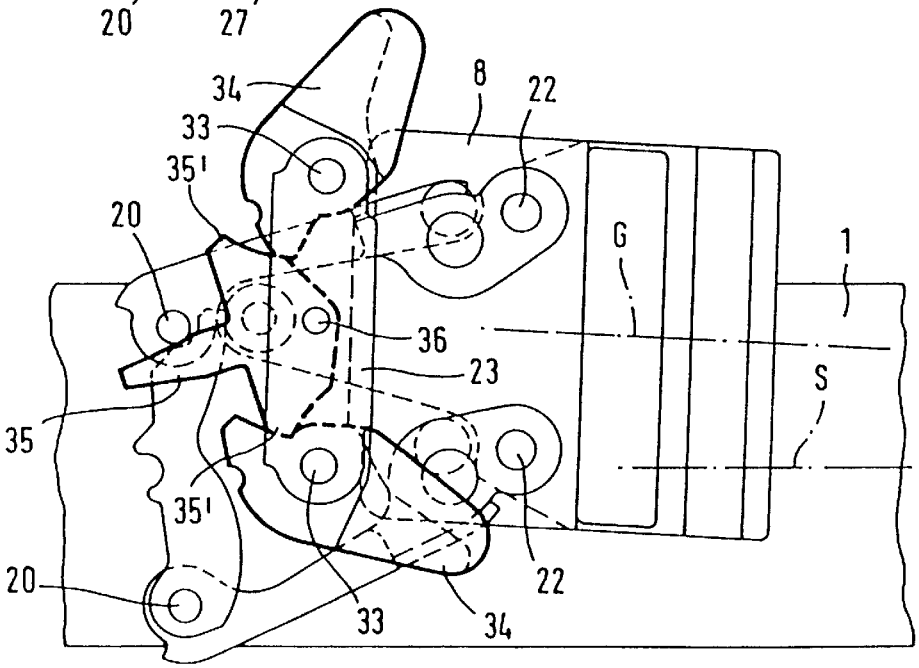
FIG. 6 shows a detail which corresponds to FIG. 4 and shows the conditions in the event of sideways disengagement.

When the sliding plate 8 is moved to a sufficient extent in the transverse direction of the ski, the locking lever 35 strikes against one of the vertical pins 20, as a result of which the locking lever 35 is pivoted, so that, on that side of the transverse wall 23 which is oriented in the direction of the sideways movement of the sliding plate 8, the sole-retaining means 34 is released by the associated extension 35' of the locking lever 35 and, in accordance with FIG. 6, can pivot outward by way of its boot-sole-retaining arm, releasing the boot sole in the process.

Arranged within the housing 3 is a bracket-like lever 40 which, in a view in the longitudinal direction of the ski, essentially has a right-angled U-profile which is open at the bottom and is mounted so as to be pivotable around a transverse pin 41 which, for its part, is arranged on the underside of the housing 3 and is fastened or mounted on the housing side walls. Arranged in the side legs of the lever 40 are slots 42 which extend in the longitudinal direction of the legs and into which there engage pins 43 which, for their part, are arranged on tongue-like extensions 44 of the abutment 30, which can be screw-adjusted on the adjustment screw 29. Thus, when the abutment 30 is displaced in the longitudinal direction of the ski relative to the housing 3, the lever 40 pivots around its transverse pin 41.

The bracket-like lever 40 comprises a leaf spring 45 which forms the upper side of the housing 3 and, in a plan view of the ski, extends essentially in the longitudinal direction of the ski and, by means of its front end, is supported on the front end wall of the housing 3, said end wall accommodating the adjustment screw 29, while the rear end, as seen in the longitudinal direction of the ski, of the leaf spring 45 rests on the top horizontal border of the transverse wall 23 or on extensions of this border on the sole-retaining means 34.

On account of its bending stressing, the spring 45 rests, with a more or less large spring force, on the underside of the central part of the bracket-like lever 40 and, by means of its ends, on the front end wall of the housing 3 and the top border of the transverse wall 23 or of the sole-retaining means 34. This results in the leaf spring 45 trying to force the transverse wall 23, and thus the sliding plate 8, against the upper side of the ski 1.

In the region of the lever 40, the spring 45 exhibits arcuate curvature with the center of curvature coinciding with the transverse pin 41. This facilitates pivoting adjustment of the lever 40.

According to a preferred embodiment of the invention, a sliding piece 46 is arranged at the rear end of the leaf spring 45 and, in a plan view of the ski, forms a T-shaped part together with the leaf spring 45. The underside of this sliding part 46 lies on the top horizontal border of the transverse wall 23, it being the case that, in a view in the longitudinal direction of the ski, according to FIG. 8, the top transverse border has an M-shaped contour, while the underside of the sliding piece 46 is designed in the form of a W. In the normal position of the transverse wall 23, i.e. when the sliding plate 8 assumes its center position in the transverse direction of the ski, the downwardly oriented "bumps" of the sliding piece 46 are located on the upwardly oriented "bumps" of the transverse wall 23.

A similar configuration is formed by the underside of the sliding-plate part 8" and a region 4', interacting therewith, on the upper side of the base plate 4.

The boot-retaining unit illustrated functions as follows: normally, the front region of the boot sole of the ski boot is enclosed in a tong-like manner by the boot-retaining means 34 in the position of the latter which is illustrated in FIG. 4, the sole-retaining means 34 also engaging over the sole border from above. If relatively large transverse forces should then act on the ski boot relative to the ski 1, for example in the event of the skier falling, the front sole part 5 of the ski boot presses against one of the sole-retaining means 34, with the result that, in the presence of a sufficiently large transverse force, the sliding plate 8, together with the sole-retaining means 34, is moved in the sideways direction relative to the ski. In this case, the sole-retaining means 34 initially still remain in their locked position, i.e. the sole-retaining means 34 are positioned, relative to the sliding plate 8, in the position illustrated in FIG. 4. The resistance which has to be overcome in this sideways movement is determined by the compressive stressing of the helical compression spring 28 and the shape of the guide arms 27 interacting with the roller 26. If the transverse force acting on the ski boot is maintained, the sliding plate 8 is displaced in the transverse direction, together with the sole-retaining means 34, to such an extent that the locking lever 35 strikes against one of the vertical pins 20 and reaches a pivot position according to FIG. 6, with the result that the sole-retaining means 34 which is at the front in the direction of the transverse displacement of the sliding plate 8—the top sole-retaining means 34 in FIG. 6—is fully unlocked and is pivoted open by the boot which continues to be forced in the sideways direction, see FIG. 6. The ski boot is consequently disengaged, i.e. released, in the sideways direction.

Since, in plan view (see FIG. 3), the ski-side and the sliding-plate-side articulation pins of the guide links 21 form a trapezium which tapers in the rearward direction of the ski 1, the sliding plate 8, in the event of sideways disengagement, pivots around a vertical axis of the ski, such that the longitudinal axis S of the ski and the longitudinal axis G of the sliding plate 8 form an acute angle which is open in the forward direction of the ski, and only slight relative movements take place between the boot sole and sliding plate 8.

In the event of the skier falling, this may result, on the one hand, in a transverse force acting on the ski boot relative to the ski and, on the other hand, in the toe region of the ski boot being pressed against the upper side of the ski to a pronounced extent. These results are typical, for example, for a forward/turning fall. The forces which force the toe region of the ski boot against the upper side of the ski inevitably result in increased contact pressure of the sliding plate 8 on the baseplate 4. This thus tends to increase the friction between the sliding plate 8 and the base plate 4, with the result that sideways movement of the sliding plate 8 relative to the base plate 4 could be made more difficult. This effect is compensated by the special shaping of the underside of the rear part 8' of the sliding plate 8 in the region 4' of the base plate 4. As soon as the downwardly oriented bumps of the underside of the sliding-plate part 8', said underside being W-shaped in profile, have displaced slightly in the sideways direction with respect to the bumps of the base-plate region 4', which is M-shaped in profile, the ramps arranged alongside the bumps have the effect that, as the contact pressure of the sliding-plate part 8' against the base plate 4 increases, an increasing force component occurs in the sideways direction, i.e. the sideways movement of the sliding plate 8 is assisted by this force component.

In the event of the skier falling backward, the forces acting on the toe region of the ski boot try to raise the ski boot from the ski. In the case of the boot-retaining unit according to the invention, this results in the front sole region of the sole-retaining means 34, together with the transverse wall 23 on which the sole-retaining means 34 is mounted, being raised counter to the force of the leaf spring 45, as is illustrated in FIG. 7. In the event of this raising movement, the boot-retaining means 34 reach a pronounced oblique position, as seen in a side view of the ski, following a predetermined lifting displacement, i.e. those ends of the sole-retaining means 34 which are oriented in the rearward direction of the ski project obliquely upward such that the front sole region of the ski boot is released from the sole-retaining means 34, i.e. the ski boot is disengaged upward.

In the event of a rearward/turning fall, the ski boot is subjected not only to the upwardly directed forces, but also to forces in the transverse direction of the ski, which, if sufficiently strong, result in sideways movement of the sole-retaining means 34 and of the sliding plate 8 relative to the ski 1. On account of the forces acting simultaneously in the upward direction, increased friction between the leaf spring 45 or the sliding piece 46 and the abutting parts of the boot-retaining unit could occur. This increased friction is then compensated, in turn, by the shape of the sliding surface of the sliding piece 46 and of the sliding surfaces, interacting therewith, on the transverse wall 23 (and the adjoining parts of the sole-retaining means 34). As soon as the bumps of the M-shaped sliding surface of the transverse wall 23 are displaced slightly in the sideways direction with respect to the bumps of the W-shaped sliding surface of the sliding piece 46, the interaction of the oblique surfaces adjoining the bumps causes a sideways force component which increases as the forces in the upward direction increase, this facilitating the sideways movement of the boot and of the boot-retaining elements of the boot-retaining unit.

Basically, the interacting sliding surfaces on the sliding piece 46 and on the transverse wall 23, on the one hand, and on the sliding plate 8 and the base plate 4, on the other hand, may be designed such that, in the event of a rearward/turning fall or of a forward/turning fall, the friction-increasing action of the forces acting on the boot in the upward direction or in the downward direction, respectively, is over-compensated. It can thus be ensured that the disengagement forces in the sideways direction in the event of socalled combined falls—forward/turning fall and rearward/turning fall—are lower than in the case of disruptive forces which act on the boot exclusively in the sideways direction.

In contrast to the embodiment illustrated, it is also possible for the leaf spring 45 to be designed, in the region of the lever 40, without the curvature according to FIG. 2. In this case, a sliding piece or molding with corresponding curvature may be arranged on the leaf spring 45.

If appropriate, it is possible for the leaf spring 45, instead of the lever 40, to have a fixed abutment on its central region and to be mounted, by means of its end region which is on the left-hand side in FIG. 2, on the displaceable abutment 30 or a supporting part which is connected fixedly thereto. In this case too, the adjustment of the abutment 30 changes the disengagement force which is determined by the leaf spring 45 in the event of a rearward fall.

Figure 9:
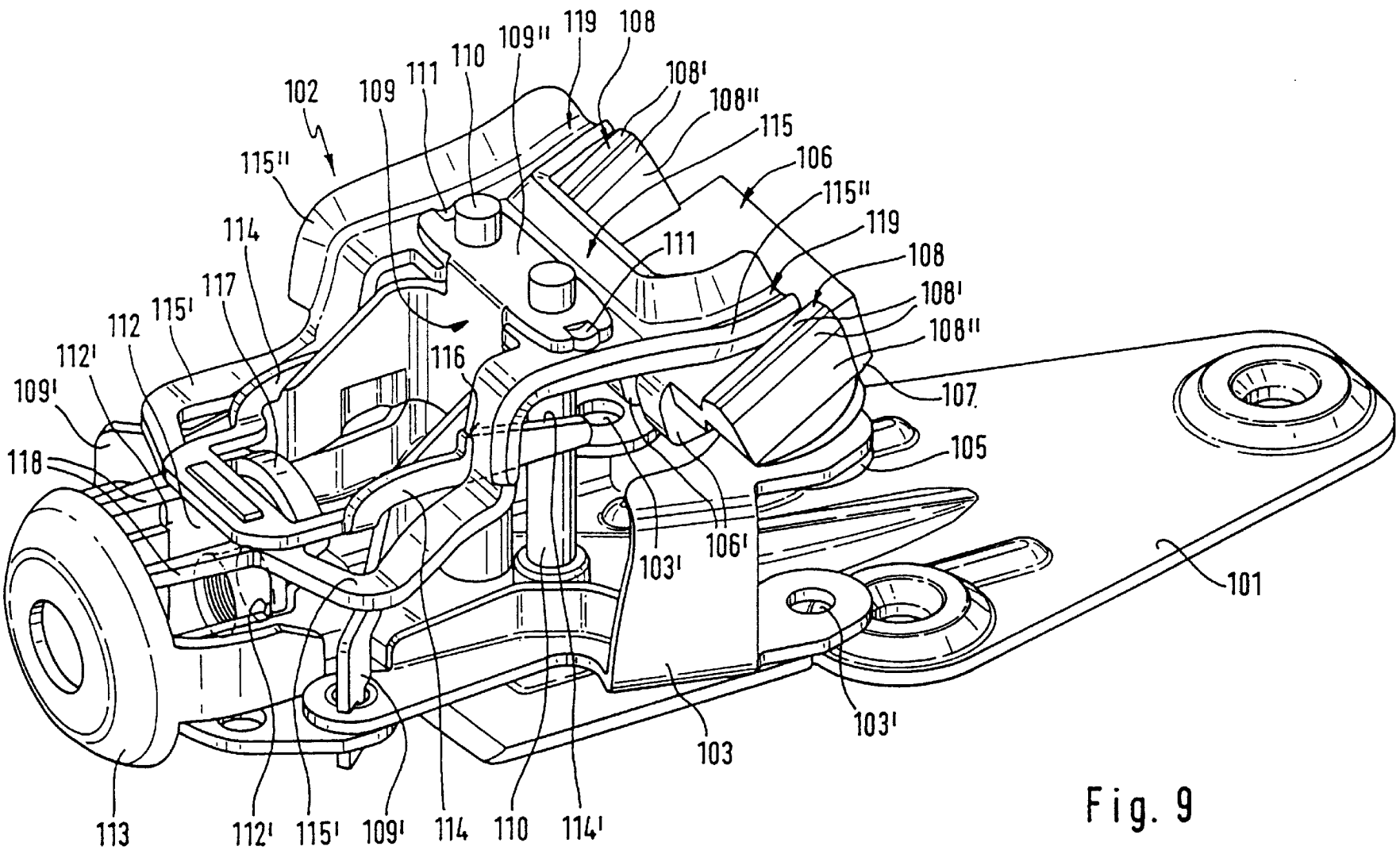
FIG. 9 shows a perspective view of a further embodiment.
Figure 10:
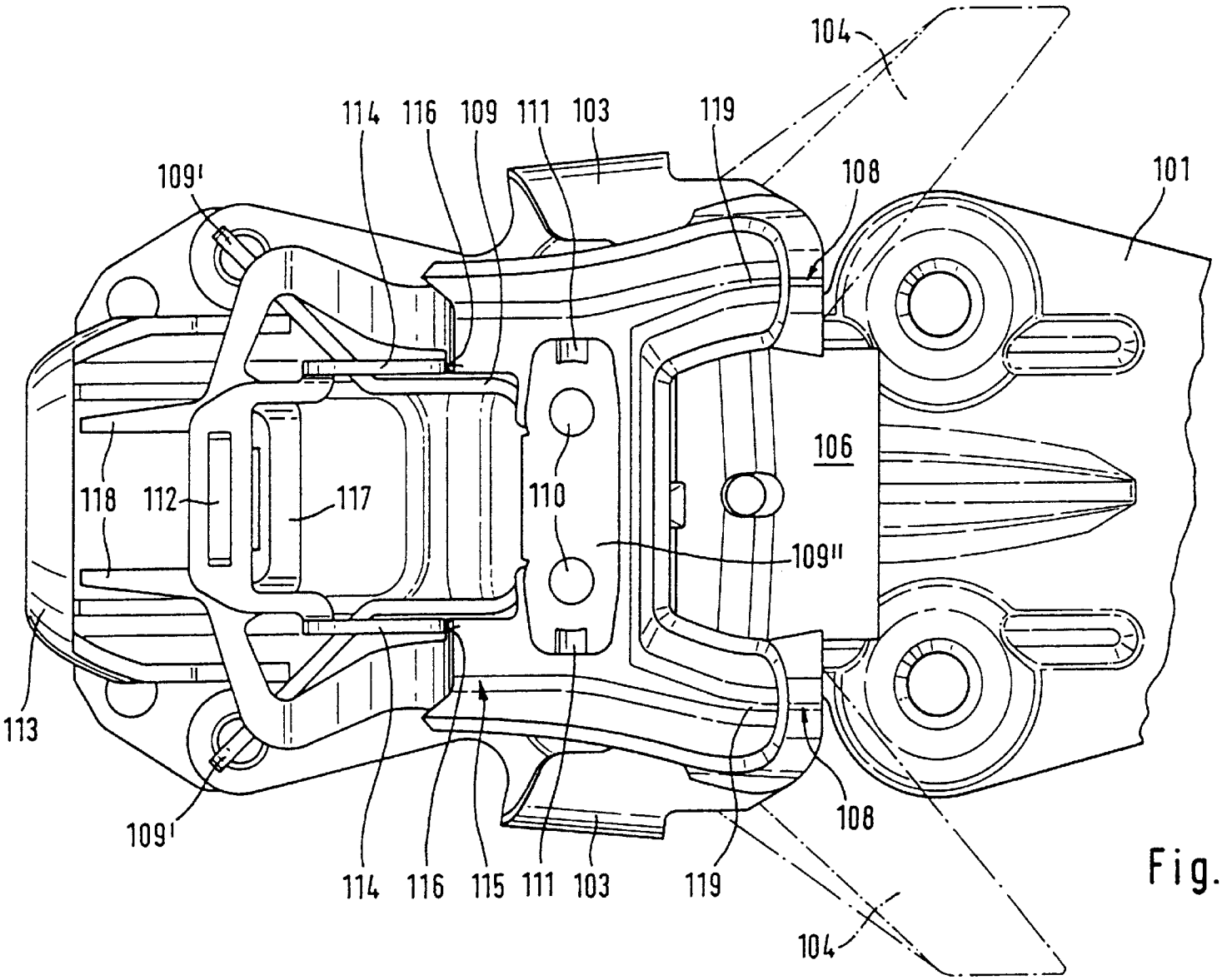
FIG. 10 shows a plan view of this embodiment.

In the case of the embodiment of FIGS. 9 to 12, a base plate 101, which is fixedly arranged on the upper side of a ski (not illustrated), bears a skeleton-like housing structure 102, which is fixedly connected to said base plate. Two guide links 103 are mounted, such that they can be pivoted around vertical axes, in the front region of said housing structure, on both sides of a vertical center longitudinal plane, bearing play ensuring that the guide links 103 can also be pivoted to some extent around a transverse axis passing through their bearing parts on the housing. At their ends which are at the rear in FIG. 9, the guide links 103 have in each case two articulation eyelets 103' which are located approximately one above the other and serve for mounting sole-retaining parts 104, which are only indicated in FIG. 10 and, in their normal position, engage laterally around the front end of the sole and thus secure this in the transverse direction. In addition, the guide links 103 are connected to one another in an articulated manner, via a flat band 105, at their top articulation eyelets 103', with the result that they always pivot together in the transverse direction. In the example of FIG. 9, the guide links 103 are deflected in the direction of the viewer.

Arranged on the flat band 105 is a sole-retaining part 106 which engages over the front border of the sole from above and engages over the front transverse border of the flat band 105 by hook-like extensions 106', by means of which the sole-retaining part 106 is secured such that it can be pivoted upward around the front edge of the flat band 105.

The rear transverse border of the sole-retaining part 106 is designed as a downwardly directed strip 107 which, in the normal position of the sole-retaining part 106, projects downward beyond the underside of the flat band 105 and rests on the border of the front end of the sole of the ski boot from above.

Formed on the upper side of the sole-retaining part 106 are two strip-like prism bodies 108 which are aligned somewhat obliquely with respect to the longitudinal axis of the ski or of the boot-retaining unit, such that the longitudinal directions of the prism bodies 108 form an angle which opens slightly toward the rear end of the ski.

In addition, the spine of the prism bodies 108 slopes upward towards the rear in the longitudinal direction of the ski.

Figure 16:
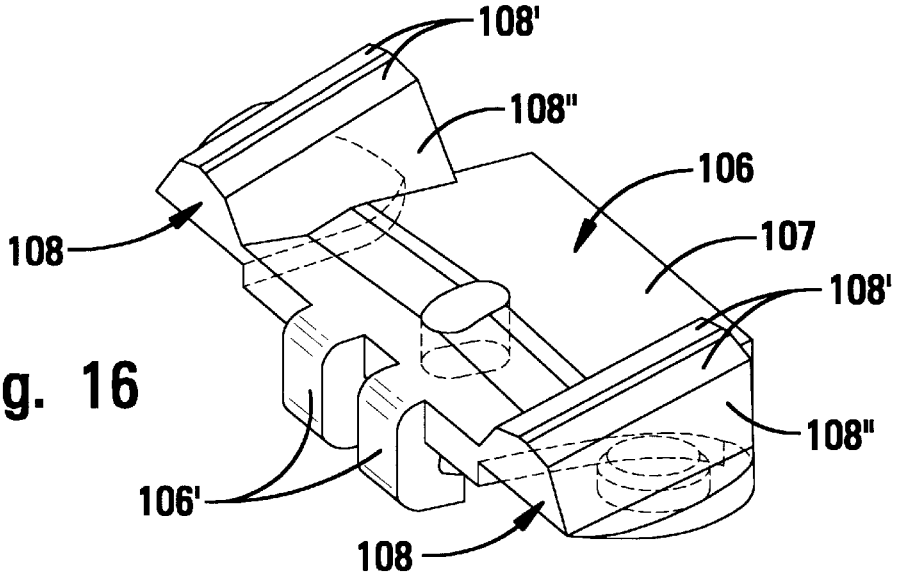
FIG. 16 shows a perspective view of the boot-retaining part shown in FIG. 12.
Figure 17:
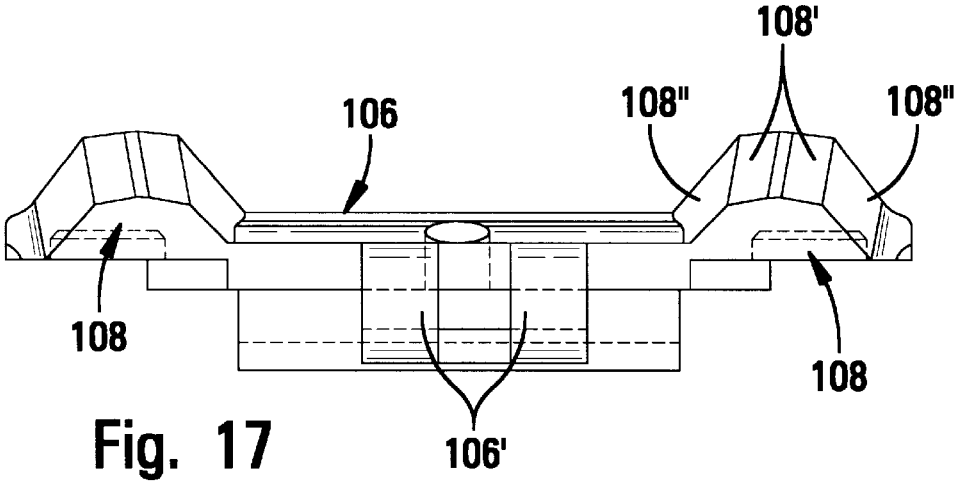
FIG. 17 shows a front view of the boot-retaining part shown in FIG. 12.
Figure 12:
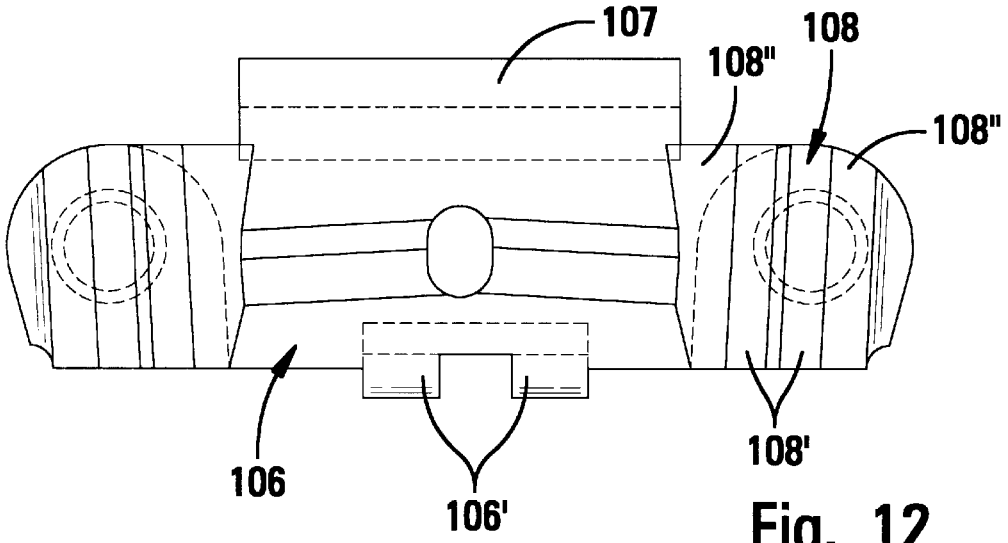

As can be seen, in particular, from FIGS. 12, 16 and 17, the spines of the prism bodies 108 each have a narrow central strip which is not inclined sideways, and then, adjoining on both sides, have oblique surfaces 108' with a slight sideways gradient of, for example, 8° with respect to the horizontal and then have adjoining flanks 108" with a steep gradient of, for example, 50° with respect to the horizontal.

The housing structure 102 has a stiffening part 109 which is arranged between the guide links 103 and is retained by feet 109', which serve as pivot axes for the guide links 103, on a housing underside and is retained on two stable housing columns 110 by an essentially horizontal top part 109". Formed laterally outside the columns 110, on the top part 109", are two beads 111 with the convex side oriented downward.

In a front section, the housing structure 102 forms a longitudinal guide for a spring abutment 112 which, in a manner which is known in principle, can be displaced and adjusted in the longitudinal direction by means of an adjustment screw (not illustrated) which is retained by a receiving part 113. This spring abutment 112 supports a helical compression spring (not illustrated) which is arranged in the longitudinal direction and controls a latching arrangement, which is known in principle and by means of which the guide links 103 are retained in a central position so as to be disengageable in the sideways direction. Arranged on the spring abutment 112 are two fork-like extensions 114 which are oriented rearward in the longitudinal direction of the ski, are supported in the vertically downward direction on protrusions on the stiffening part 109 and have top borders 114' which slope downward in a ramp-like manner in the rearward direction.

A spring part 115 is fixedly retained on the columns 110 in the longitudinal and transverse directions of the boot-retaining unit. In plan view, this spring part has an H-shape in the region of the columns and of the top part 109" of the stiffening part 109, the crossbar of the H being arranged behind the top part 109", as seen in the longitudinal direction. The rearwardly facing ends of the side parts of the H interact, in a manner outlined below, with the prism bodies 108 of the sole-retaining part 106. In front of the top part 109" of the stiffening part 109, the side parts of the H are angled vertically downward, the downwardly angled parts being provided with shoulders 116 which interact, in a manner outlined below, with the top borders 114" of the extensions 114.

Beneath the shoulders 116, the side parts of the H are designed, in the manner of a spring tongue, with spring brackets 115' which extend in the forward direction and are connected to one another between the extensions 114 by a transverse bracket 117. Connected in front of this are extensions 118 which are aligned in the longitudinal direction and are supported on the spring abutment 112 between the extensions 114 and shoulders 112' without obstructing the adjustment capability of the spring abutment 112.

The spring brackets 115' between the shoulders 116 and the transverse bracket 117 are compliant in the manner of a leaf spring, while those regions of the spring part 115 which adjoin in the upward and rearward directions are comparatively stiff since, here, the side parts of the spring part 115 have laterally upwardly bent borders 115" and, accordingly, a channel profile.

The rearwardly oriented ends of the spring part 115 form prism bodies 119 similar to the prism bodies 108 of the sole-retaining part 106, a narrow central face which is arranged, without inclination, in the transverse direction being adjoined by oblique surfaces which are inclined upward to a slight extent and then by flanks which are inclined steeply upward. In this arrangement, the outer flanks merge into the borders 115"; the inner flanks are connected rigidly to one another via an upwardly bent border of the transverse web of the spring parts 115 beside the top part 109".

The arrangement illustrated functions as follows:

In the normal position, i.e. when the ski boot and its sole are fixed properly in the boot-retaining unit, the guide links 103 and the sole-retaining part 106 assume their central position, in which the sole-retaining parts 104 engage around the lateral sole borders and the sole-retaining means 106 engages, by its strip 107, over the front border of the sole from above. In this arrangement, the prism bodies 108 of the sole-retaining part 106 are located on the prism bodies 119, to be precise such that the narrow central regions of the prism bodies, i.e. their "roof ridges", are located one upon the other.

If, then, an excessive sideways force is exerted on the boot, the boot sole presses against one of the lateral sole-retaining parts 104, with the result that the guide links 103 are deflected counter to a restoring force produced by the disengagement spring mechanism. With sufficient deflection, the sole-retaining part 104 which is located at the front, as seen in the movement direction in each case, pivots outward and releases the boot. In this respect, the boot-retaining unit according to the invention functions in the conventional manner.

If, then, the boot is subjected to a force which forces the toe of the boot in the upward direction, the sole-retaining part 106 is forced in the upward direction against the prism bodies 119, in which case the sole-retaining part 106 tries to pivot (in the anticlockwise direction in FIG. 9) around the front transverse border of the flat band 105, said border being gripped by the hook-like extensions 106' of the sole-retaining part 106. With sufficient upward force, the prism bodies 119 of the spring part 115 can be bent upward such that the sole-retaining part 106 releases that border of the sole which it overlaps, and thus releases the sole of the boot and the boot itself, in the upward direction. In this case, on the one hand, the spring force of the spring brackets 115' has to be overcome. In addition, the spring part 115 is supported on the top borders 114' of the extensions 114 sooner or later by its shoulders 116, with the result that that region of the spring part 115 which is stiffened by the borders 115" is also bent elastically to a more or less pronounced extent.

The forces which are to be overcome here are determined by the position of the spring abutment 112 and of the extensions 114 which are connected thereto. If the spring abutment 112 in FIG. 9 is displaced far to the right with the extensions 114, the prism bodies 119 form a particularly stiff abutment for the prism bodies 108 of the sole-retaining part 106. If, in contrast, the spring abutment 112 in FIG. 9 is displaced to the left together with the extensions 114, the prism bodies 119 are retained in a comparatively compliant manner.

Since the restoring forces which try to keep the guide links 103 in their normal position are also changed correspondingly with a displacement of the spring abutment 112, the stiffness with which the prism bodies 119 are retained is thus changed in the same manner as the restoring force which acts on the guide links 103.

Figure 18:
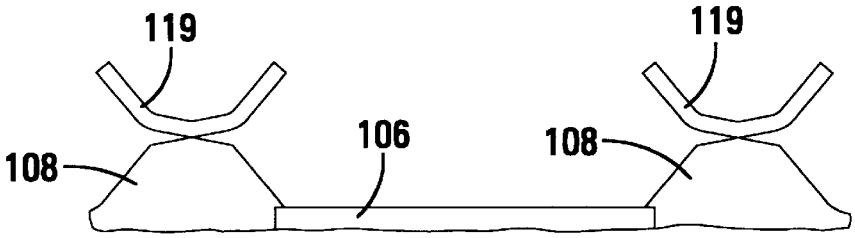
FIG. 18 shows a typical position of the elements of the boot-retaining arrangement shown in FIG. 13 when not subjected to a force.
Figure 19:
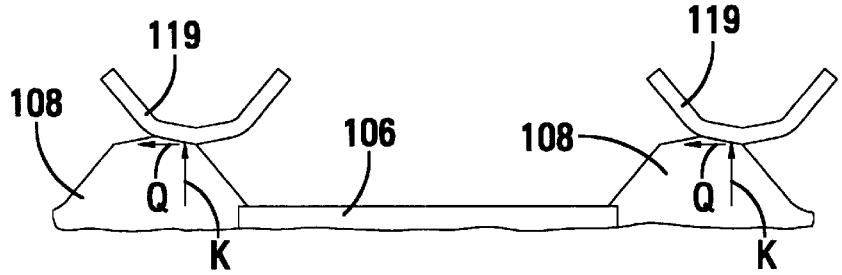
FIG. 19 shows a typical position of the elements of the boot-retaining arrangement shown in FIG. 13 when subjected to a force having both a sideways component and an upward component.

Now, let us assume that the boot is subjected to a force with a sideways component and an upward component. If this force is sufficiently large, the guide links 103 will pivot some way to the side, with the result that the prism bodies 108 of the sole-retaining part 106 and the prism bodies 119 of the spring part 115 pass out of the position illustrated in FIG. 18, in which the "roof ridges" of the prism bodies 108 and 119 are located one upon the other, into the position of FIG. 19, in which the prism bodies 108 and 119 are located somewhat eccentrically one upon the other, i.e. their slightly inclined oblique surfaces to the sides of their central strip or of their roof ridges interact with one another. On account of the upwardly directed force K which acts on the sole-retaining part 106, the oblique surfaces are correspondingly pressed against one another, in which case the inclination of these oblique surfaces produces a certain force component Q in the sideways direction, in which the guide links 103 have already been deflected to some extent. This sideways component Q largely compensates for the friction between the prism bodies 108 and 119.

Figure 13:
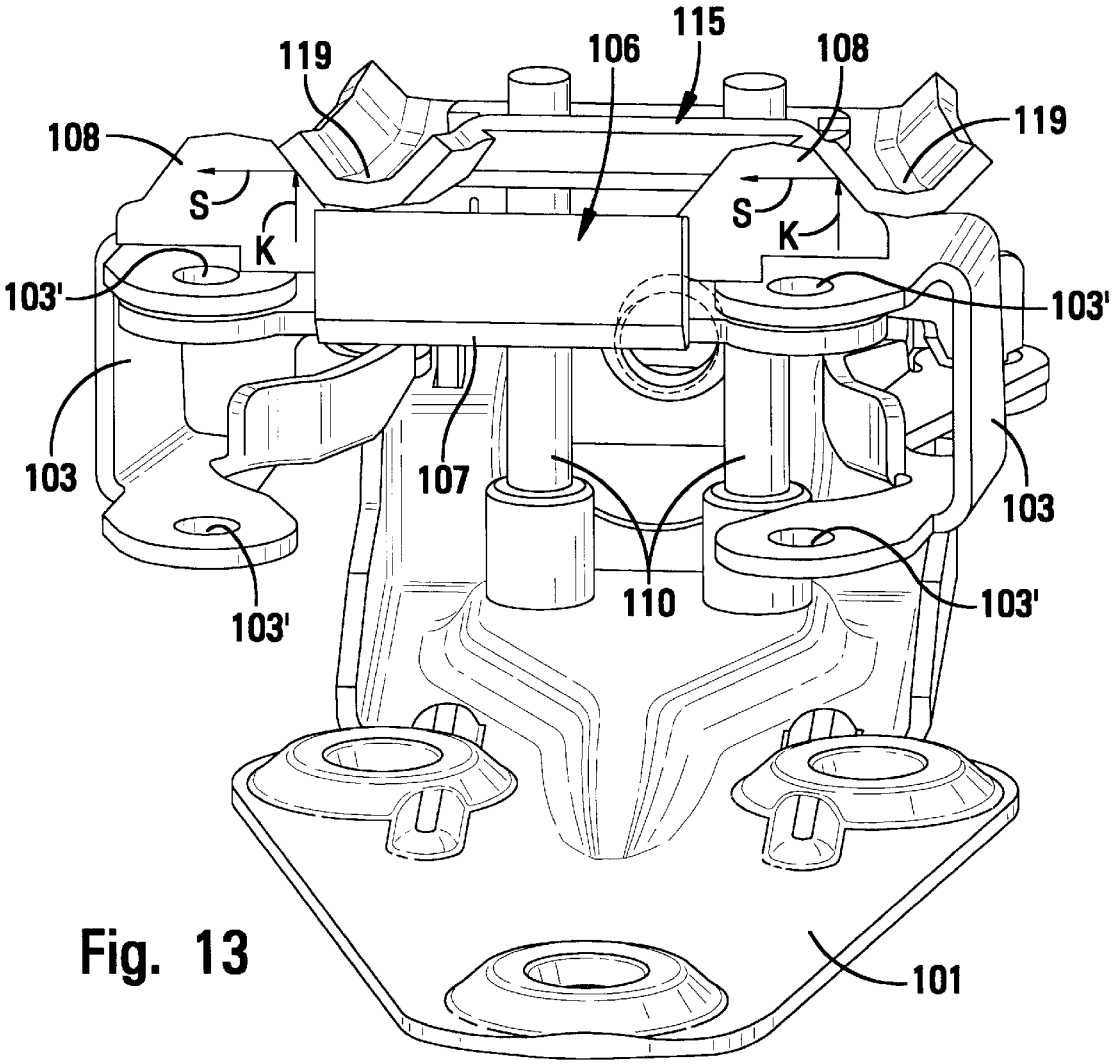
FIG. 13 shows a perspective rear view of the boot-retaining unit.

If sufficient force continues to act on the boot in the sideways direction, the steep flanks of the prism bodies 108 and 119 come into contact with one another, in accordance with FIG. 13, with the result that a considerable sideways force S is produced if the sole-retaining part 106 continues to be forced upward on account of upwardly directed forces K.

This results in the guide links 103 being pivoted further to the side even in the case of exclusively upwardly directed external forces, and the boot-retaining unit releasing the boot in the sideways direction on the one hand, by unlocking one of the sole-retaining parts 104 and also in the upward direction as a result of increasing upward movement or as a result of increasing upward pivoting of the sole-retaining part 106.

As a result, in the case of increasing sideways movement, the sole-retaining part 106 is thus rendered capable of moving increasingly in the upward direction and, finally, can release the boot in the upward direction. Furthermore, a force which forces the sole-retaining part 106 upward assists, by interaction of the flanks of the prism bodies 108 and 119 with one another, increasing sideways pivoting of the guide links 103 since the upwardly directed force produces a sideways force which acts on the guide links and counteracts the binding disengagement resistance which counteracts sideways disengagement of the binding, with the result that, ultimately, with a continuing upward force, the boot or the sole is released more easily in the sideways direction.

FIG. 9 shows the sole-retaining means 106 in a position in which the prism bodies 108 have been displaced in the direction of the viewer relative to the prism bodies 119 and the sole-retaining means 106, together with those ends of the guide links 103 which retain it, and with the flat band 105, have reached an upwardly raised position.

Figure 14:
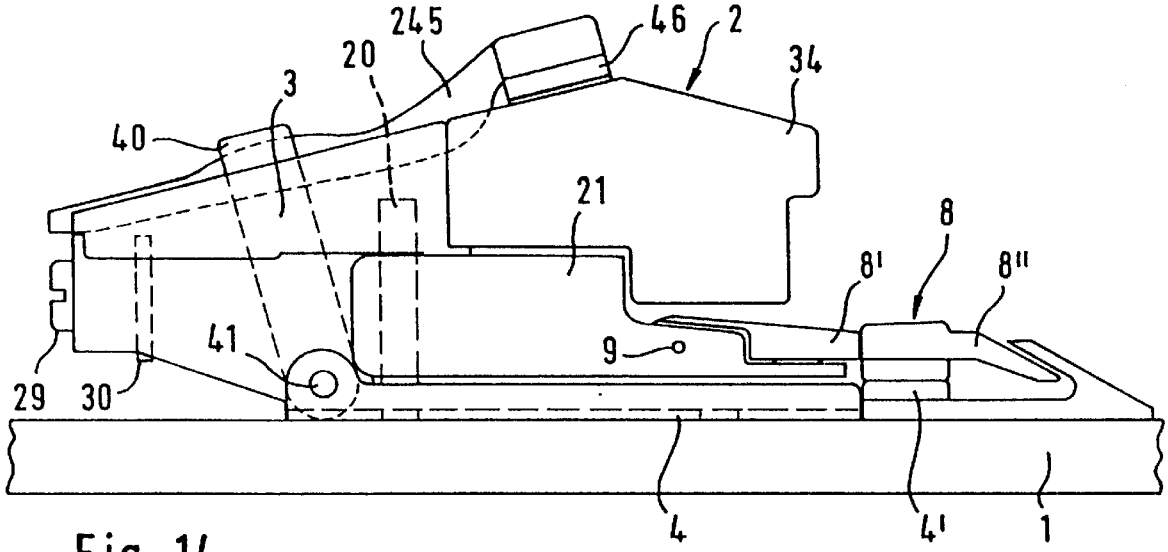
FIG. 14 shows an illustration of a modified embodiment, the illustration corresponding to FIG. 1.

FIG. 14 shows a modification of the embodiment illustrated in FIG. 1. The embodiment of FIG. 14 differs from the embodiment of FIG. 1 essentially by virtue of the fact that, in FIG. 14, the leaf spring 45 of FIG. 1 is replaced by a comparatively rigid lever part 245 which with its left-hand end, as seen in FIG. 14, is supported on a fixed part of the housing 3, or such that it is essentially fixed on the ski, and its central region, on the top side, is covered over by the lever element 40 such that the sliding element 46 which is arranged at the right-hand end of the lever part 245 is secured against moving in the upward direction to any great extent. The lever element 40 may cover over a curve on the top side of the lever part 245, it being possible for this curve to be shaped such that, when the lever element 40 pivots in the clockwise direction, the sliding element 46 is forced some way downward.

Pivoting the lever element 40 increases the vertical rigidity of the lever part 245 at the sliding element 46, with the result that the transverse wall 23 which interacts with the sliding element 46, see FIG. 8, is supported particularly firmly in the vertically upward direction and/or is forced vertically downward with a more or less pronounced force.

In this way, the interacting oblique surfaces on the sliding element 46 and on the transverse wall 23 can produce a more or less pronounced sideways force which forces the transverse wall 23, and thus the sole-retaining means 34 which it retains, in the sideways direction when, in relation to the central position of FIG. 8, the transverse wall 23 has been moved some way in the sideways direction as a result of a correspondingly large sideways force having been exerted on the ski boot.

Figure 11:
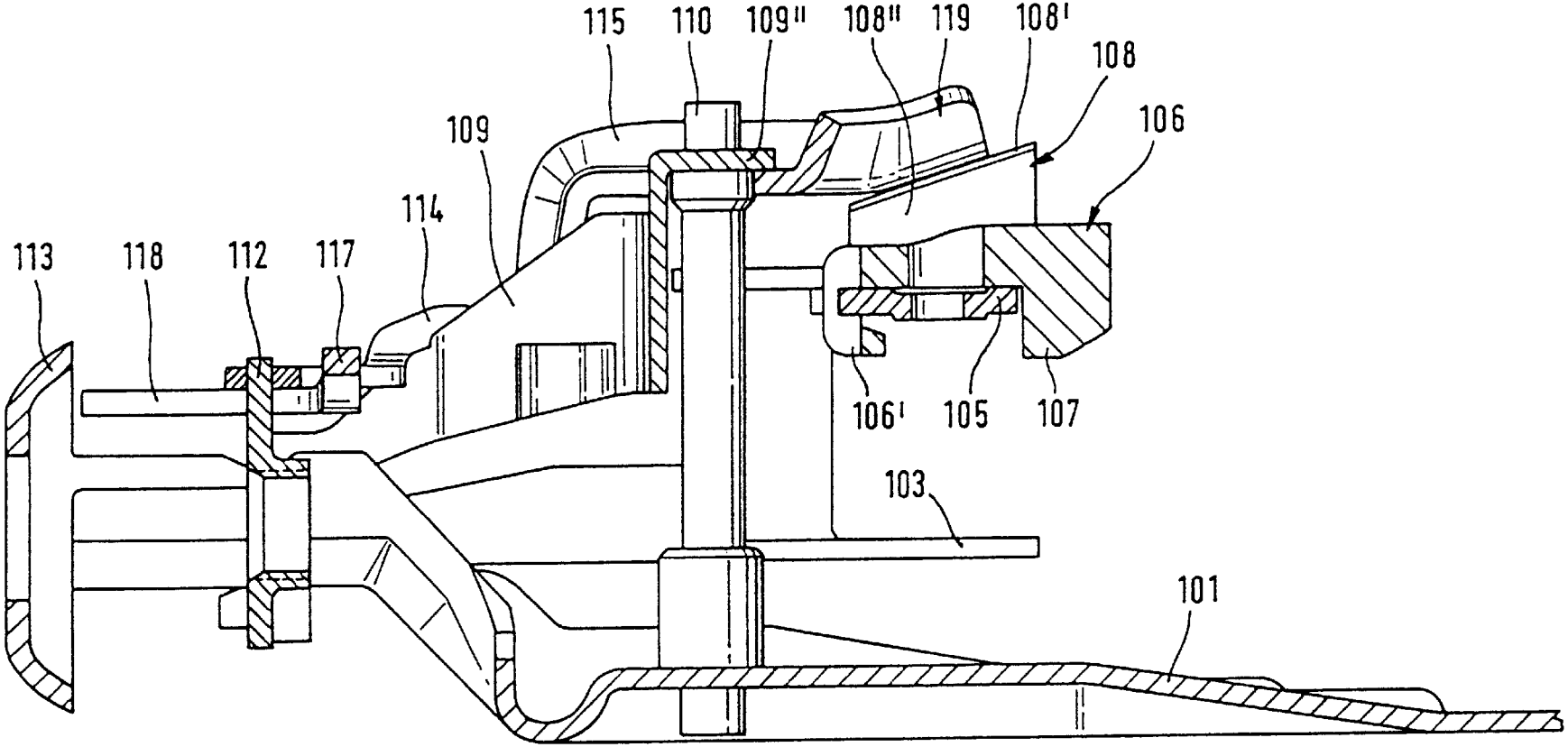
FIG. 11 shows an associated vertical longitudinal section through the center, FIG. 12 a plan view of a boot-retaining part of this embodiment which secures the ski-boot sole against upward movement.
Figure 15:
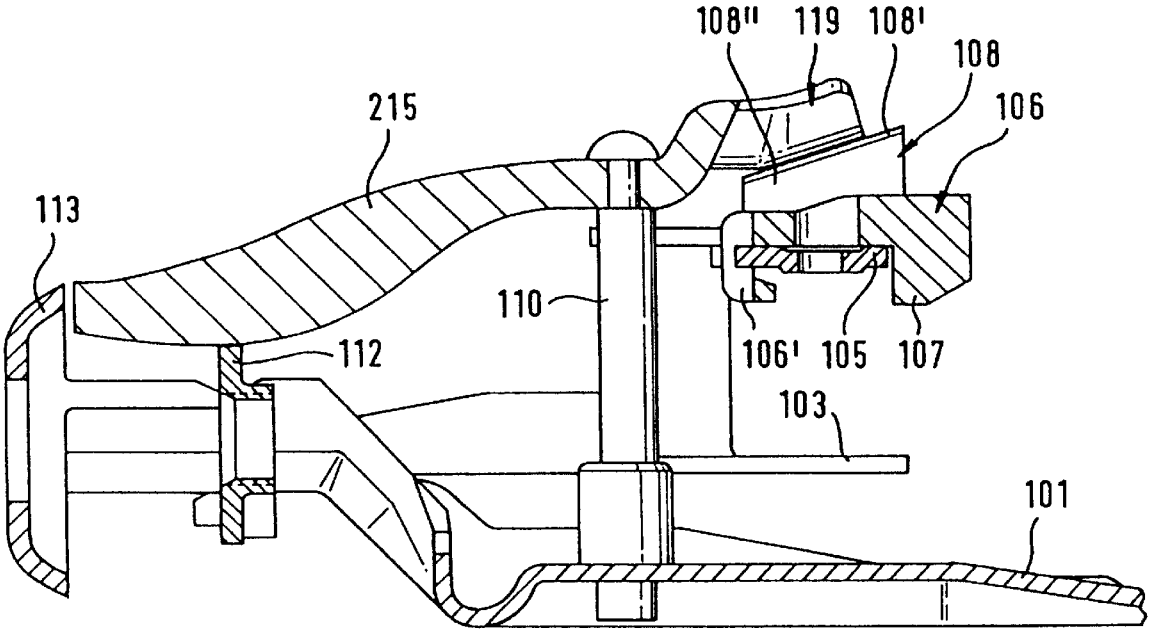
FIG. 15 shows an illustration of a further embodiment, the illustration corresponding to FIG. 11.

In the embodiment of FIG. 15, the leaf-spring part 115 of FIG. 11 is replaced by a relatively rigid rocker 215 which is retained on the housing-mounted columns 110 such that it can pivot around a transverse axis of the ski and of which the left-hand end, as seen in FIG. 15, is supported on the spring abutment 112 against a vertical movement in the downward direction. The other end of the rocker 215 is formed by the prism bodies 119, which interact with the prism bodies 108.

Adjustment of the spring abutment 112 shortens the lever arm by which that part of the rocker 215 which is oriented to the left, as seen in FIG. 15, from the housing-mounted column 110 is supported on the spring abutment 112. This simultaneously changes the rigidity with which the prism bodies 119 are secured against vertical movements in the upward direction.

If appropriate, that side of the rocker 215 which interacts with the spring abutment 112 in order to support the rocker 215 may be designed as an oblique or an arcuate surface such that, in the event of the spring abutment 112 being adjusted to the right, any play which may be present between the abutment 112 and the rocker 215 is increasingly reduced and/or the rocker 215 is increasingly stressed against the prism bodies 108 by way of the prism bodies 119.

Here too, in turn, there is a change in the sideways forces which are produced by interaction of the prism bodies 119 and 108 when these prism bodies are deflected, analogously to the illustrations B and C of FIG. 13, relative to one another out of the central position illustrated in the illustration A of FIG. 13 as a result of relatively pronounced sideways forces being exerted on the respective ski boot.

The lever part 245 and the rocker 215 may be designed as plastic parts or as parts of a binding housing.

The invention has been described in detail with particular emphasis on the preferred embodiments, but variations and modifications within the spirit and scope of the invention may occur to those skilled in the art to which the invention pertains.

We claim:

1. A boot-retaining unit of a disengageable ski binding, in particular a boot-retaining unit for retaining the toe region of a ski boot, having a first adjustable spring unit for controlling disengagement of the boot in the direction of a transverse axis of the boot, a second adjustable spring unit for controlling disengagement of the boot in the direction of a vertical axis of the boot, wherein an actuating element for simultaneously adjusting the two spring units interacts with an adjustable abutment common to the first and the second spring units.

2. The boot-retaining unit as claimed in claim 1, wherein a boot-retaining arrangement, which can be disengaged in the sideways direction, and a carrying part, which retains said arrangement, are arranged with vertical play relative to the upper side of the ski and are stressed against the upper side of the ski by means of a spring element of the second spring unit.

3. The boot-retaining unit as claimed in claim 1, wherein the first spring unit has a helical compression spring, of which the compressive stressing can be adjusted by a spring abutment, which can be adjusted in the direction of the spring axis by means of the actuating element, at one end of the helical spring.

4. The boot-retaining unit as claimed in claim 3, wherein the adjustable abutment is coupled to a lever element, which forms an adjustable support of a leaf spring, which is arranged as the spring element of the second spring unit.

5. The boot-retaining unit as claimed in claim 4, wherein the lever element interacts with an arcuate supporting surface of the leaf spring forming an arcuate path, and the center of curvature of the arcuate path coincides with a pivot pin of the lever element.

6. The boot-retaining unit as claimed in claim 5, wherein the arcuate path is formed by a correspondingly curved region of the leaf spring.

7. The boot-retaining unit as claimed in claim 3, wherein the first and second spring units have a common adjustable abutment, and the second spring unit is designed as a leaf spring.

8. The boot-retaining unit as claimed in claim 7, wherein a free end of the leaf spring presses down in the direction of the upper side of the ski, a boot-retaining mean, which engages over a sole border from above.

9. The boot-retaining unit as claimed in claim 8, wherein the boot-retaining means and the free end of the leaf spring interact with one another via pressure-transmitting elements and pressure-transmitting surfaces, which make it possible for the boot-retaining means to execute a sideways movement in the direction of a transverse axis of the boot with a vertical, upward component relative to the free end of the leaf spring.

10. The boot-retaining unit as claimed in claim 8, wherein the boot-retaining means and a sliding plate, which is coupled to the boot-retaining means and supports the ski boot, are supported on the ski via pressure-transmitting elements, which make it possible for the boot-retaining means or the sliding plate to execute a sideways movement in the direction of a transverse axis of the boot with a vertical, downward component relative to the upper side of the ski.

11. Boot-retaining unit as claimed in claim 8, wherein the boot-retaining means is arranged on two guide links, which are aligned essentially in the longitudinal direction of the ski and are mounted so as to be pivotable around ski-mounted vertical pins which are arranged on both sides of the longitudinal axis of the ski.

12. The boot-retaining unit as claimed in claim 10, wherein vertical pins are arranged in a region just in front of the tip of the boot, and those ends of the guide links which are remote from the vertical pins are located beneath the toe region of the ski boot.

13. The boot-retaining unit as claimed in claim 2, wherein the adjustable abutment is coupled to a continuation element, which forms an adjustable support of a spring part, which is arranged as the spring element of the second spring unit.

14. The boot-retaining unit as claimed in claim 13, wherein the continuation element has a generally fork-like shape and the spring part has a generally H-like shape.

15. A boot-retaining unit of a disengageable ski binding, in particular a boot-retaining unit for retaining the toe region of a ski boot, having a first adjustable spring unit for controlling disengagement of the boot in the direction of a transverse axis of the boot, an adjustable supporting unit for controlling disengagement of the boot in the direction of a vertical axis of the boot, wherein an actuating element for simultaneously adjusting the first spring unit and the supporting unit interacts with an adjustable abutment common to the first spring unit and the supporting unit, the supporting unit including a supporting element being disposed entirely above the adjustable abutment.

16. The boot-retaining unit as claimed in claim 15, wherein the first spring unit has a helical compression spring, of which the compressive stressing can be adjusted in the direction of the spring axis by means of the actuating element, at one end of the helical spring.

17. The boot-retaining unit as claimed in claim 15, wherein a boot-retaining arrangement, which can be disengaged in the sideways direction, and a carrying part, which retains said arrangement, are arranged with vertical play relative to the upper side of the ski and are stressed against the upper side of the ski by means of the supporting element of the supporting unit.

18. The boot-retaining unit as claimed in claim 17, wherein the supporting element is a lever part and the adjustable abutment is coupled to a lever clement, which forms an adjustable support of the lever part, which is arranged as part of the supporting unit.

19. The boot-retaining unit as claimed in claim 18, wherein the lever element interacts with an arcuate supporting surface of a top surface of the lever part forming an arcuate path, and the center of curvature of the arcuate path coincides with a pivot pin of the lever element.

20. The boot-retaining unit as claimed in claim 19, wherein the arcuate path is formed by a correspondingly curved region of the lever part.

21. The boot-retaining unit as claimed in claim 17, wherein the supporting element is a rocker which directly engages the adjustable abutment.

22. The boot-retaining unit as claimed in claim 21, wherein the adjustable abutment interacts with an arcuate lower surface of the rocker.

23. The boot-retaining unit as claimed in claim 17, wherein a free end of the supporting element presses down in the direction of the upper side of the ski, a boot-retaining means, which engages over a sole border from above.

24. The boot-retaining unit as claimed in claim 23, wherein the boot-retaining means and the free end of the supporting element interact with one another via pressure-transmitting elements and pressure-transmitting surfaces, which make it possible for the boot-retaining means to execute a sideways movement in the direction of a transverse axis of the boot with a vertical, upward component relative to the free end of the supporting element.

25. The boot-retaining unit as claimed in claim 23, wherein the boot-retaining means and a sliding plate, which is coupled to the boot-retaining means and supports the ski boot, are supported on the ski via pressure-transmitting elements, which make it possible for the boot-retaining means execute a sideways movement in the direction of a transverse axis of the boot with a vertical, downward component relative to the upper side of the ski.

26. Boot-retaining unit as claimed in claim 23, wherein the boot-retaining means arranged on two guide links, which are aligned essentially in the longitudinal direction of the ski and are mounted so as to be pivotable around ski-mounted vertical pins which are arranged on both sides of the longitudinal axis of the ski.

27. The boot-retaining unit as claimed in claim 26, wherein the vertical pins are arranged in a region just in front of the tip of the boot, and those ends of the guide links which are remote from the vertical pins are located beneath the toe region of the ski boot.

* * * * *